United States Patent [19]

Perry et al.

[11] Patent Number: 4,502,409

[45] Date of Patent: Mar. 5, 1985

[54] APPARATUS FOR TREATING TEXTURIZED STRANDS AND YARNS

[75] Inventors: Brian D. Perry; Paul K. Mathews, both of Newark, Ohio

[73] Assignee: Owens-Corning Fiberglas Corporation, Toledo, Ohio

[21] Appl. No.: 307,559

[22] Filed: Oct. 1, 1981

[51] Int. Cl.[3] ..... B05C 3/12

[52] U.S. Cl. ..... 118/410; 118/420

[58] Field of Search ..... 134/15; 118/420, 401, 118/234, 125, 410; 28/290; 65/3.1

[56] References Cited

U.S. PATENT DOCUMENTS

| | | | |
|---|---|---|---|
| 2,234,986 | 3/1941 | Slayter et al. | 65/3.1 |
| 3,025,205 | 3/1962 | Young | 118/420 X |
| 3,488,670 | 1/1970 | Benson | 28/271 |
| 4,013,435 | 3/1977 | Kane et al. | 118/420 X |
| 4,046,103 | 9/1977 | Yakuboff | 118/125 |
| 4,059,068 | 11/1977 | Guillermin et al. | 118/420 |
| 4,267,007 | 5/1981 | Kellogg | 118/420 X |
| 4,329,750 | 5/1982 | Binnersley | 118/420 X |

*Primary Examiner*—Marc L. Caroff

*Attorney, Agent, or Firm*—Ronald C. Hudgens; Greg Dziegielewski

[57] ABSTRACT

The disclosure embraces a method of and apparatus for applying a liquid material aftertreatment to texturized or bulked strand or yarn and particularly strand or yarn of glass fibers or filaments. The method and means of application of the liquid material aftertreatment to the texturized or bulked strand or yarn involves advancing the texturized strand or yarn over an applicator, applicator body or member wherein the applicator body is provided with an opening or orifice through which the liquid material is delivered onto the texturized or bulked strand or yarn and the liquid treated texturized or bulked strand or yarn wound into a package on a rotating body. One of said bodies is reciprocated with respect to the other for traversing the liquid treated texturized strand or yarn lengthwise of the package during winding of the package. Applicator bodies having different size orifices are interchangeable for treating strands or yarns of different volumes or yields in order to secure saturation of the texturized strand or yarn by the liquid material.

3 Claims, 9 Drawing Figures

APPARATUS FOR TREATING TEXTURIZED STRANDS AND YARNS

TECHNICAL FIELD

The invention relates to applying a liquid material as an aftertreatment to texturized or bulked strands or yarns, particularly bulked or texturized strands or yarns of glass fibers and winding the treated strands or yarns into packages.

BACKGROUND ART

Texturized or bulked strands or yarns have been conventional for sometime and when required it is a practice to apply an aftertreatment of a liquid material onto the texturized or bulked strands or yarns. A conventional type of roll applicator has been used to apply a liquid size or other liquid treatment onto a texturized or bulked strand or yarn such as shown in the U.S. patent to Benson U.S. Pat. No. 3,488,670.

A roll type applicator has not been entirely satisfactory because the texturized or bulked strand or yarn is not completely saturated with the liquid treating material and, in further processing the treated texturized or bulked strand or yarn, a substantial amount of fuzz is encountered which impairs the processing such as knitting, braiding or weaving the texturized product. Furthermore the bulk in the texturized strand or yarn is not satisfactorily retained during further processing because of the inefficiency of the roll-type applicator to provide uniform application of the liquid treatment in the texturized or bulked strand or yarn.

DISCLOSURE OF THE INVENTION

The present invention involves a method of and apparatus for applying a liquid material aftertreatment to texturized or bulked strand or yarn and particularly strand or yarn of glass fibers or filaments, the method and means of application of the liquid aftertreatment to the texturized or bulked yarn assuring that the liquid is applied uniformly and complete saturation of the texturized strand or yarn is attained.

The texturized or bulked strand or yarn is preferably of glass fibers or filaments wherein the fibers or filaments are attenutated in a conventional manner from streams of glass from a stream feeder and the strand or yarn subjected to a texturizing process such as a texturing process of the general character described in the patent to Benson hereinbefore mentioned or in the U.S. patents to Benson U.S. Pat. Nos. 3,381,346 and 4,058,968.

The aftertreatment method and apparatus of the invention involves advancing or engaging a texturized or bulked strand or yarn in a recess or groove in an applicator body or member, the recess in the applicator member being provided with an opening or orifice through which liquid material is delivered onto the texturized or bulked strand or yarn in the recess, the treated strand or yarn being collected in a wound package on a rotating body or mandrel.

During the treatment of the texturized strand or yarn, the applicator body or the body on which the package is collected is traversed with respect to the other body for distributing the liquid treated texturized strand or yarn lengthwise of the package. A manifold supports the applicator body or applicator and various applicator bodies or applicators having different sizes or characters of fluid delivery openings or orifices may be quickly selected and applied to the manifold for the treatment of texturized strands or yarns of different sizes or character.

Through this method and arrangement, the liquid of the aftertreatment may be applied uniformly to and complete saturation obtained for the texturized strand or yarn. The bulk in the strand or yarn is retained and lower fuzz is encountered during further processing operations such as knitting, braiding or weaving.

Further objects and advantages are within the scope of this invention such as relate to the arrangement, operation and function of the related elements of the structure, to various details of construction and to combinations of parts, elements per se, and to economies of manufacture and numerous other features as will be apparent from a consideration of the specification and drawings.

BRIEF DESCRIPTION OF THE DRAWINGS

The details of the invention will be described in connection with the accompanying drawings in which.

BEST MODE FOR CARRYING OUT THE INVENTION

The method and apparatus of the invention are particularly usable for applying liquid material as an aftertreatment onto texturized or bulked strand or yarn fashioned of fibres or filaments attenuated from heat-softened mineral material such as glass, but it is to be understood that the method and apparatus may be utilized for liquid material aftertreatment for bulked or texturized strand or yarn formed of fibers or filaments of other fiber-forming material.

Figure 2:
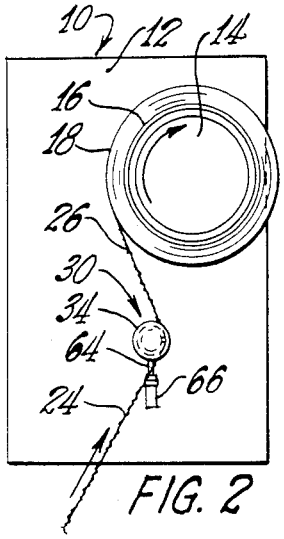
FIG. 2 is a side elevational view of the apparatus shown in FIG. 1.
Figure 1:
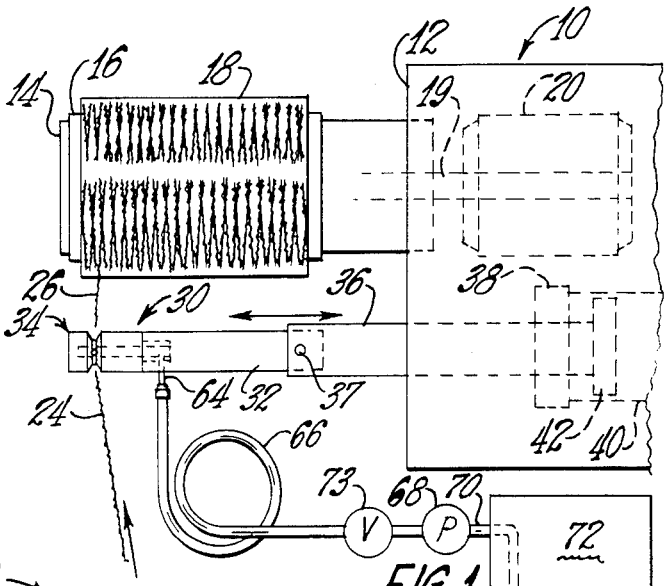
FIG. 1 is a front elevational view of a portion of a winding apparatus for carrying out the method of applying aftertreatment liquid material onto texturized or bulked strand or yarn.

Referring initially to FIGS. 1 and 2 of the drawings, there is illustrated a form of apparatus for applying liquid material onto a pretexturized or bulked strand or yarn preferably fashioned of glass fibers or filaments and winding the treated texturized or bulked strand or yarn into a wound package. The texturized or bulked strand or yarn is preformed by a suitable method such as a method of the character disclosed in the U.S. Pat. Nos. 3,488,670 or 4,058,968 to Benson.

The texturized or bulked strand or yarn of glass fibers of filaments is prewound into packages. The texturized or bulked strand or yarn is unwound from a package and subjected to an aftertreatment of liquid material and the treated texturized or bulked strand or yarn wound into a package.

In the drawings, FIGS. 1 and 2, the apparatus is inclusive of a winding machine 10 having a frame or housing 12. Mounted in bearings (not shown) within the housing 12 and extending from the housing is a rotatable winding body or mandrel 14 for winding the treated texturized bulk strand or yarn into a package. Telescoped onto the mandrel is a thin-walled tube or sleeve 16 driven by the mandrel and upon which the treated bulked or texturized strand or yarn is wound into a package 18.

The winding body or mandrel 14 is driven by a shaft 19 of an electrically energizable motor 20 supported within the housing 12. The motor 20 is controlled in a conventional manner so that as the package increases in size the mandrel or winding body 14 will be progressively reduced in speed so that the treated texturized or bulked strand or yarn moves at a substantially uniform linear rate as the package is being wound.

The untreated texturized or bulked strand or yarn 24 is drawn from a supply or creel package (not shown) and is treated by aftertreatment liquid material applied by an applicator as the treated texturized bulk strand or yarn 26 is wound into the package 18.

The liquid material for application to the texturized or bulked strand or yarn 24 may be a size, binder, dye or other liquid and is applied to the texturized strand or yarn by an applicator arrangement or assembly 30. The applicator arrangement or assembly 30 includes a manifold 32 and an applicator, applicator body, cap, fitting or member 34, the manifold assembly 30 being shown in further detail in FIG. 4.

The manifold 32 of the applicator arrangement 30 is connected with a member, shaft or rod 36 by a bolt or other securing means 37, the member or rod extending into the winding machine housing 12. The member or rod 36 is longitudinally reciprocable for reciprocating the manifold 32 and the applicator, member or fitting 34 whereby the applicator traverses the treated texturized strand or yarn 26 lengthwise of the package for distributing the treated texturized strand or yarn lengthwise of the package 18.

The applicator, applicator body, fitting, cap or member 34 is preferably made of brass but may be fashioned of other suitable metal or alloy if desired. In the embodiment illustrated, the rod 36 extends through an opening in a head 38 on one end of a cylinder 40, a piston 42 reciprocable within the cylinder 40 being attached to the piston rod 36. The cylinder 40 has a head (not shown) at its other end.

The assembly of the cylinder 40, cylinder heads and piston 42 is of conventional construction and fluid means is alternately delivered into the cylinder at opposite sides of the piston 42 to reciprocate the piston rod 36 and the applicator arrangement 30 parallel with the axis of the mandrel or mandrel body 14 for traversing the strand lengthwise of the package. It is to be understood that other conventional means may be employed for reciprocating or traversing the applicator assembly 30.

Figure 4:
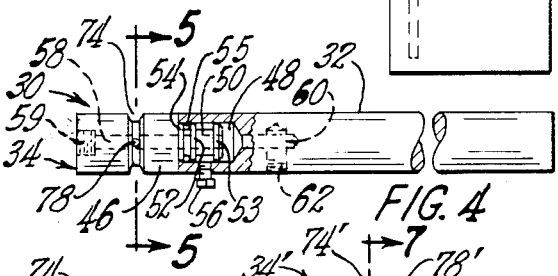
FIG. 4 is an elevational view of the applicator assembly including a manifold and applicator body or member for applying aftertreatment material onto texturized or bulked strand or yarn.

With particular reference to FIG. 4, the applicator or member 34 has a portion 46 which is preferably of the same diameter as the manifold 32. The manifold 32 has a bore or passage 48 which snugly receives a tenon portion 50 of the applicator 34. Two ring-like portions 52 and 53 are slidably received in the bore and a reduced diameter portion between the rings is adapted to receive a setscrew 56 mounted in a threaded opening in the manifold 32 for removably securing the applicator 34 in the bore 48 of the manifold 32.

Spaced from the ring 52 is a ring 54 defining a groove in which is disposed a sealing ring 55 to prevent leakage of liquid treating material. The applicator 34 is of tubular construction and has a central liquid receiving passage or chamber 58 in communication with the bore 48. The outer end of the applicator 34 is provided with a threaded opening to receive a closure or plug 59. The closure 59 is removable in order to provide for cleaning out the passage 58 in the applicator.

The manifold 32 is provided with a central passage or chamber 60 in communication with the bore 48 and the passage 58 in the applicator 34. The manifold 32 is provided with a threaded transverse opening 62 in communication with the passage 60, the threaded opening 62 adapted to accommodate a threaded fitting 64 shown in FIGS. 1 and 2.

As shown in FIG. 1, the threaded fitting 64 is connected by a flexible tubing or flexible pipe 66 with a pump 68, and the pump 68 is connected by a tube or pipe 70 with a supply of treating material contained within a supply container 72. The tube 66 is provided with a valve means or valve 73 for controlling the flow of liquid treatment material.

Figure 5:
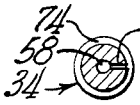
FIG. 5 is a detail sectional view taken substantially on the line 5—5 of FIG. 4.

The portion 46 of the applicator or member 34 is provided with a groove, recess or other guide means 74. The applicator 34 is provided with a metering orifice or outlet 78 opening into the groove or guide means 74 and in communication with the central passage 58 in the applicator 34 as particularly shown in FIG. 5. The texturized or bulked strand or yarn 24 is advanced from a supply package or creel package (not shown) and engages in and passes through the guide means or groove 74 and past the orifice 78 and receives aftertreatment liquid material from the orifice.

In the operation of the arrangement shown in FIGS. 1 and 2, the pump 68 is started to supply treating liquid under comparatively low pressure to the orifice 78 in the groove of the applicator 34. The texturized or bulked strand or yarn is engaged in the guide means or groove 74 and winding of the treated texturized strand or yarn 26 initiated on the tube 16 mounted on the winding mandrel or mandrel body 14.

The motor 20 is energized to rotate the mandrel tube 16 to wind the treated texturized strand or yarn into a package 18. The applicator assembly or arrangement 30 is reciprocated by alternate delivery of pressure fluid controlled by conventional means at the respective sides of the piston 48 so that the applicator is reciprocated to traverse the treated texturized strand or yarn lengthwise of the package 18.

An important feature of the invention resides in the provision and use of applicator bodies or members having different size outlets or orifices 78 through which aftertreatment of liquid material is delivered onto texturized or bulked strands or yarns. Several applicators may be provided each with a different size orifice for delivering liquid material onto texturized strand or yarn depending upon the size or yield of yarn to be treated so that there is substantially complete saturation of the texturized strand or yarn with the treating liquid.

The size or diameter of orifice 78 may vary within wide limits depending upon the member of fibers in a texturized strand or yarn, the extent of texturizing or bulking of the strand or yarn and the viscosity factor of the treating material. Thus several different interchangeable applicators, members or fittings are provided, each having an orifice of appropriate size to secure saturation of the texturized or bulked strand or yarn.

Interchangeability of applicators is provided by simply loosening the setscrew 56, removing one applicator or applicator body and inserting an applicator or applicator body having a different size orifice or orifice of different configuration dependent upon the characteristics of the texturized strand or yarn to be treated. The pump 68 may be of a low pressure type providing sufficient pressure to secure adequate delivery of treating liquid material from the orifice to saturate the texturized strand or yarn.

The size or diameter of the orifice may vary from about 0.020 inch to about 0.065 inch or larger, the orifice of a selected applicator being of a size so that the texturized or bulked strand or yarn advancing through the recess or groove 74 will be completely saturated with the liquid treatment material. The applicator bodies may be quickly interchanged by releasing the setscrew 56, removing one applicator and inserting a different applicator into the bore 48 of the manifold 32.

Figure 3:
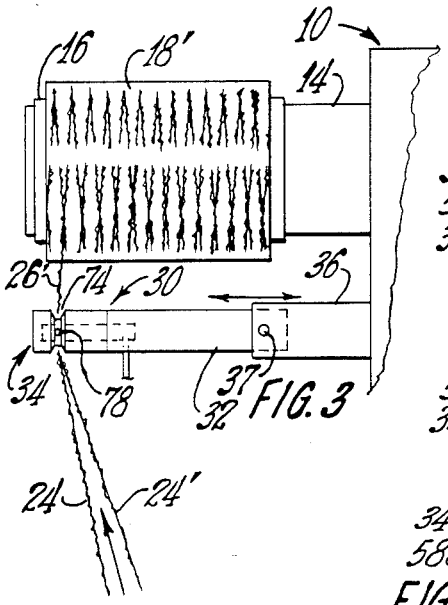
FIG. 3 illustrates the use of the applicator with combined texturized strands or yarns.

FIG. 3 illustrates a portion of the winding machine 10 of the character shown in FIG. 1 wherein two texturized or bulked strands or yarns 24 and 24' are engaged in the groove or recess 74 of an applicator 34 and therein combined to form a composite yarn 26' saturated with liquid treatment material from the orifice 78.

The applicator assembly 30 is reciprocated to traverse the composite treated texturized yarn lengthwise to form a package 18' of the texturized composite treated yarn wound on a sleeve or tube 16 rotated by the mandrel 14. It is to be understood that while FIG. 3 shows two texturized or bulked strands or yarns 24 and 24' brought together in a composite yarn, a yarn having a greater number of strands or yarns may be treated in the manner illustrated in FIG. 3.

Figure 6:
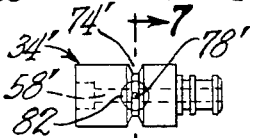
FIG. 6 is an elevational view of a modified form of applicator.
Figure 7:
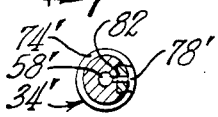
FIG. 7 is a sectional view taken substantially on the line 7—7 of FIG. 6.

FIGS. 6 and 7 illustrate a modified form of applicator or applicator body or member. The applicator 34' is of a configuration substantially the same as the applicator body 34. The applicator 34' is provided with a peripheral recess or groove 74', the applicator 34' having a central passage 58'.

Arranged in a transverse bore in the applicator 34' at the region of the recess 74' is a cylindrical insert or member 82 of a material such as carbide or other material having a high resistance to abrasion by glass fibers or filaments. The insert 82 is of a dimension such that it may be press fitted into the transverse bore in the applicator body 34'. The axis of the insert 82 passes through the central region of the recess 74'.

The insert 82 is provided with a central orifice or opening 78' for delivering liquid treatment material from the passage 58' onto a texturized or bulked strand or yarn passing through the recess or groove 74' at the region of the orifice 78'.

Through the use of the insert of carbide material engaged by the texturized strand or yarn moving through the recess 74' the carbide material resists abrasion and wear of the fibers of the texturized strand or yarn onto which the treatment material is delivered from the orifice 78'. The applicator illustrated in FIGS. 6 and 7 is interchangeable with the applicator 34 shown in FIG. 4 and may be quickly assembled and secured in the bore 48 in the manifold 32 by manipulation of the setscrew 56.

Several applicators of the character shown in FIGS. 4, 6 and 7 may be provided in which each applicator has a different sized orifice for use in treating different sizes or yields of texturized strands or yarns.

Figure 8:
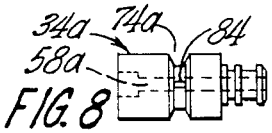
FIG. 8 is an elevational view of another form of applicator.

FIG. 8 illustrates an applicator, applicator body or member for use in treating yarn of large volume or yield. The applicator **34*a* is of the same general configuration as the applicators 34 and 34'. The applicator 34*a* has a peripheral groove or recess 74*a* of slightly greater width than the groove or recess 74. The applicator 34*a* has a central passage or chamber 58*a* for accommodating treating liquid material. The applicator 34*a* at the region of the recess 74*a* is provided with a slot-like or elongated orifice 84, the orifice being elongated in the axial direction of the applicator 34*a***.

The peripheral recess or groove **74*a* is of a greater width than the groove or recess 74 in FIG. 4 to accommodate a yarn of higher volume or yield. The slot or elongated orifice 84** may be of a different length or width in different applicators to accommodate texturized strands or yarns of various volumes or yields.

The length of the elongated slot or orifice 84 is approximately the same as the width of the peripheral recess or groove **74*a* at its base. The slot or orifice 84 may be made of various widths dependent upon the volume of strand or yarn being treated with the liquid aftertreatment material. The elongated orifice 84 is in communication with the central passage or chamber 58*a* and receives aftertreatment liquid material from an arrangement of the character illustrated in FIG. 1**.

The applicator, applicator body or member **34*a* is interchangeable with the other applicators and may be assembled with the manifold 32 in the same manner that the other applicators are assembled with the manifold 32 and secured through the manipulation of the setscrew 56**.

The width of the peripheral recess or groove **74*a* and the length and width of the elongated or slotted orifice 84 may be varied dependent upon the size or yield of texturized strand or yarn to be treated. The slotted orifice 84** may be of a length of 0.100 inch or more and of a width of 0.025 inch or more dependent upon the amount of liquid required to saturate the texturized strand or yarn. An average size slotted orifice for use with most large size texturized strand or yarn would be of a length of about 0.130 inches and a width of about 0.040 inches.

It is preferable that with an elongated orifice 84, the base width of the recess or groove **74*a* would be about equal to the length of the elongated orifice. It is to be understood that the applicator 34*a* with an elongated orifice or material delivery opening may be provided with a carbide insert such as the insert 82 shown in FIGS. 6 and 7, such insert being of a diameter slightly greater than the entrance width of the slot or orifice 84**.

Figure 9:
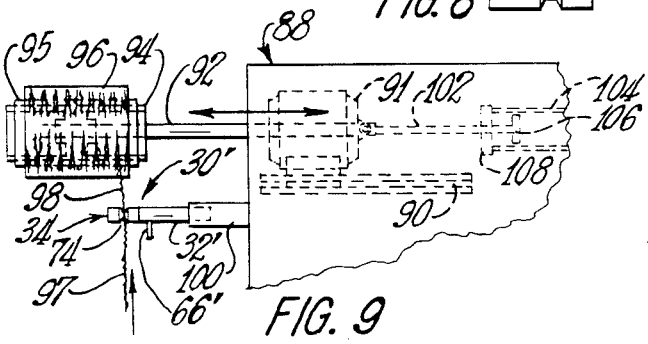
FIG. 9 is a modification of the arrangement shown in FIG. 1.

FIG. 9 is a fragmentary elevational view of a portion of a winding machine of modified construction. In the arrangement shown in FIG. 9 the winding mandrel or body is mounted for reciprocation and rotation and the applicator assembly is relatively stationary. The winder or winding machine 88 is provided with track means 90 in which is reciprocably mounted a drive motor 91.

The motor shaft 92 is equipped with a winding body or mandrel 94 supporting a thin-walled sleeve or tube 95 on which is wound a package 96 of texturized strand or yarn 98 treated with liquid material. A stationary support member 100 mounted by the housing of the winding machine 88 is equipped with an applicator arrangement 30′ comprising a manifold 32′ and an applicator 34 or any of the other applicators described herein mounted by the manifold 32′ in the manner hereinbefore described.

In the arrangement shown in FIG. 9, the motor 91 and the winding body or mandrel 94 is reciprocated along the track 90. Secured to the housing of the motor 91 is a piston rod or member 102 which extends into a cylinder 104 in which is reciprocably mounted a piston 106 connected with the rod 102. The cylinder is equipped with end heads, one of which is shown at 108.

The piston is reciprocated by alternate admission of fluid under pressure to the respective sides of the piston 106 to reciprocate the piston 106, the rod 102, the motor 91, shaft 92, the winding body or mandrel 94 and the package 96 being formed on the thin-walled tube 95.

The untreated texturized strand or yarn 97 from a supply (not shown) is engaged in the peripheral groove or recess 74 in the applicator 34 and the untreated texturized strand or yarn receives liquid treatment material from the orifice in the applicator 34 or the orifice in any other applicator substituted for the applicator 34. The manifold 32′ is supplied with treating liquid from a supply through a tube 66′.

By reciprocation of the mandrel or winding body 94 in the manner illustrated in FIG. 9 with the applicator 34 in a relatively stationary position, the treated texturized or bulked strand or yarn 98 is wound into a package 96, reciprocation of mandrel 94 traversing the treated texturized strand lengthwise of the package. It is to be understood that a number of strands or yarns may be combined and treated as a composite yarn with liquid material delivered from the orifice in the applicator.

It is apparent that, within the scope of the invention, modifications and different arrangements may be made other than as herein disclosed, and the present disclosure is illustrative merely, the invention comprehending all variations thereof.

We claim:

1. Apparatus for collecting a strand comprising:
   - a rotatable mandrel adapted to wind said strand therearound;
   - an applicator section having a coating supply orifice, a passage in communication with said orifice, and a guide means adapted to receive said strand advancing therethrough;
   - a manifold section adapted to reciprocably move along the axis of rotation of said mandrel, said manifold section having a bore adapted to receive said applicator section and a passageway in communication with said passage of said applicator section;
   - releasable fastener means to join said applicator section to said manifold section;
   - means for supplying a liquid coating to said passageway of the manifold section to supply said orifice to coat said strand;
   - means for moving said manifold section to move the strand advancing to said mandrel such that said strand is collected on said mandrel in helically wound, overlapping layers.

2. The apparatus of claim 1 wherein said guide means is a groove in said applicator means, and wherein said supply orifice is located at the base of said groove.

3. The apparatus of claim 2 wherein said manifold section is removably positioned at the distal end of a reciprocable rod.

* * * * *